United States Patent [19]

Jamrus

[11] 4,323,427

[45] Apr. 6, 1982

[54] DECELERATION BUFFER FOR HYDRAULIC LINEAR MOTION DRIVE

[75] Inventor: Kenneth J. Jamrus, San Jose, Calif.

[73] Assignee: General Electric Company, San Jose, Calif.

[21] Appl. No.: 73,720

[22] Filed: Sep. 10, 1979

[51] Int. Cl.[3] ..... G21C 7/08

[52] U.S. Cl. ..... 376/230; 376/234; 91/407

[58] Field of Search ..... 176/36 R, 36 SA; 188/284, 287, 289, 30; 91/408; 92/85 B

[56] References Cited

U.S. PATENT DOCUMENTS

| | | | |
|---|---|---|---|
| 3,020,887 | 2/1962 | Hobson et al. | 91/408 |
| 3,020,888 | 2/1962 | Braun | 91/408 |
| 3,212,981 | 10/1965 | Tollet et al. | 176/36 R |
| 3,462,345 | 8/1969 | Jabsen | 176/36 SA |
| 3,677,141 | 7/1972 | Lagerquist et al. | 92/85 B |
| 3,762,994 | 10/1973 | Kunzel | 176/36 S |
| 4,035,230 | 7/1977 | Bevilacqua | 176/36 S |
| 4,073,684 | 2/1978 | Cepkauskas | 176/36 S |

FOREIGN PATENT DOCUMENTS

| | | | |
|---|---|---|---|
| 2433381 | 1/1975 | Fed. Rep. of Germany | 176/36 SA |

*Primary Examiner*—Sal Cangialosi

*Attorney, Agent, or Firm*—Ivor J. James, Jr.; Samuel E. Turner; Raymond G. Simkins

[57] ABSTRACT

Braking of the motion of a fluid-actuated drive is provided by a buffer arrangement which is normally sealed to prevent vaporization of the fluid in a buffer cylinder and which isolates the drive piston rings from braking pressures.

4 Claims, 2 Drawing Figures

DECELERATION BUFFER FOR HYDRAULIC LINEAR MOTION DRIVE

BACKGROUND

Figure 1:
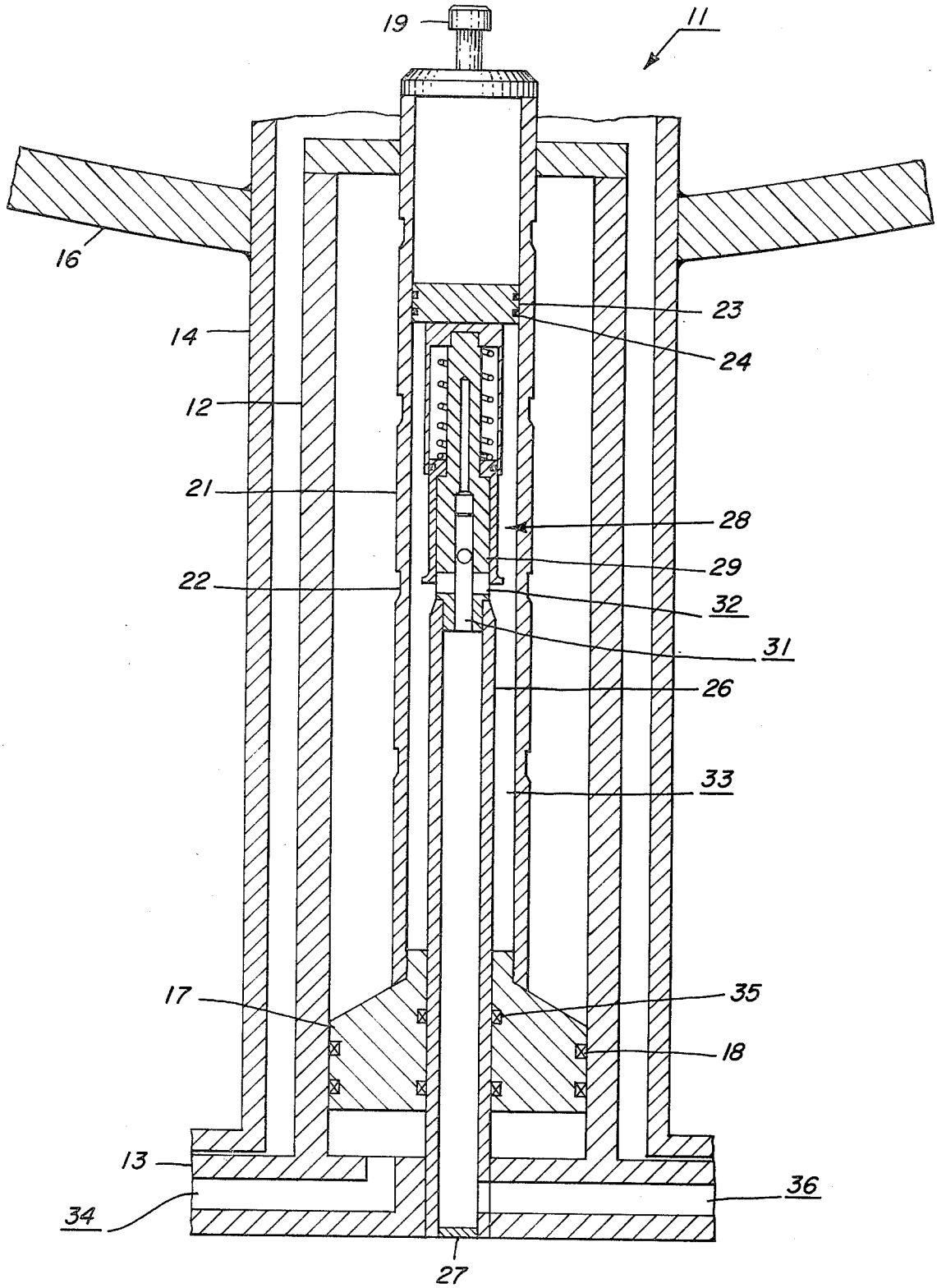

This invention relates to hydraulic or fluid-actuated drives particularly useful for inserting an element into a pressurized vessel such as for actuating the control rods of a nuclear reactor.

In known types of nuclear power reactors, for example as used in the Dresden Nuclear Power Station near Chicago, Ill., the reactor core comprises a plurality of speed fuel assemblies arranged in an array capable of self-sustained nuclear fission reaction. The core is contained in a pressure vessel wherein it is submerged in a working fluid, such as light water, which serves both as coolant and as a neutron moderator. Each fuel assembly comprises a tubular flow channel, typically of approximately square cross section, surrounding an array of elongated, fuel elements or rods containing suitable fuel material, such as uranium or plutonium oxide, supported between upper and lower tie plates. The fuel assemblies are supported in spaced array in the pressure vessel between an upper core grid and a lower core support plate. The lower tie plate of each fuel assembly is formed with a nose piece which fits in a socket in the core support plate for communication with a pressurized coolant supply chamber. The nose piece is formed with openings through which the pressurized coolant flows upward through the fuel assembly flow channels to remove heat from the fuel elements. A typical fuel assembly of this type is shown, for example, by D. A. Venier et al in U.S. Pat. No. 3,654,077. An example of a fuel element or rod is shown in U.S. Pat. No. 3,378,458.

A plurality of control rods, containing neutron absorbing material, are selectively insertable in the spaces or gaps among the fuel assemblies to control the reactivity of the core. In a known core arrangement, such as shown for example in U.S. Pat. No. 3,020,887, the control rod blades have a cross or cruciform transverse cross section shape whereby the "wings" of the blades of each control rod are insertable in the spaces between an adjacent set of four fuel assemblies.

Suitable control rod drive mechanisms are provided, as shown in the above-mentioned U.S. Pat. No. 3,020,887, to selectively move the control rods into and out of the core whereby the neutron population and hence the core power level can be controlled by the non-fission capture of neutrons by the neutron absorbing material in the control rods. Suitable such neutron absorbing materials, including commonly used boron, are set forth in the above-mentioned U.S. Pat. No. 3,020,887.

During normal reactor operation at power, a significant number of the control rods, for example one-half or more, are withdrawn from the core. The remaining control rods are inserted to various degrees to control reactor power level and shape.

In the event that it becomes necessary to shut down the reaction suddenly, the control rod drives are actuated to insert rapidly all of the control rods to their full extent in the core. (Such an operation commonly is referred to as a "scram.")

Such scram action entails rapid acceleration of the drives and control rods, high speed insertion and, concomitantly, rapid deceleration of the moving masses near the end of the insertion stroke. For example, in known prior systems the scram velocity may be in the order of 5 ft/sec (152 cm/sec). Thus control rod drives typically include a braking or deceleration arrangement, such as a hydraulic buffer, to avoid excessive mechanical shock on the drive mechanism. Examples of such deceleration arrangements are described in U.S. Pat. Nos. 3,020,887 and 3,020,888 which are incorporated herein by reference.

As shown in FIG. 4 of U.S. Pat. No. 3,020,887 the control rod driving device comprises a hollow main or drive piston carrying a hollow indexing tube and fitted for linear motion in a cylinder. Positioned within the drive piston and indexing tube is a stop piston tube at the top end of which is a stop piston. Sealing rings are provided between the drive piston and the stop piston tube and between the drive piston and the cylinder.

A braking arrangement therein includes a series of vertically spaced fluid orifices in the stop piston tube just below the stop piston near the end of drive piston travel. These orifices are progressively closed off by passage thereover and beyond of the sealing rings as the drive piston approaches the end of its stroke. This progressively increases the flow resistance for fluid flow out of the hollow indexing tube with a resulting deceleration force on the drive piston.

A disadvantage of this system is that the deceleration forces create relatively high pressure differences across the sealing rings. More recent requirements for faster scram times require faster acceleration and higher insertion speed (for example, in the order of 10 ft/sec, 305 cm/sec). The result is higher deceleration forces and, consequently, even greater pressure differences across the sealing rings with the danger of premature sealing ring failure.

An object of the invention is a drive braking arrangment which relieves the drive piston sealing rings of deceleration pressures.

SUMMARY

In accordance with the invention a drive braking arrangement includes a normally sealed fluid-filled buffer chamber or cylinder formed in the stop piston. The buffer cylinder is normally sealed by an annular buffer piston surrounding a buffer shaft which connects the top end of the piston tube to the stop piston. A spring in the buffer cylinder urges the buffer piston out of the buffer cylinder and into engagement with a shoulder on the buffer shaft by which the buffer cylinder is normally sealed to prevent escape of the fluid therein.

Near the end of its insertion stroke the drive piston engages a flange on the lower end of the buffer piston and drives the buffer piston into the buffer cylinder. This unseals the buffer cylinder and allows fluid flow therefrom through a series of spaced radial orifices and an axial bore in the buffer shaft. As the buffer piston is driven further into the buffer cylinder it progressively covers and passes beyond the orifices, thus increasing resistance to fluid flow from the buffer cylinder and, hence, increasing the braking action.

When the drive piston has been arrested, the buffer spring urges the piston out of the cylinder, fluid is drawn in and the piston seats on the buffer shaft shoulder to again seal the cylinder.

DRAWING

Figure 2:
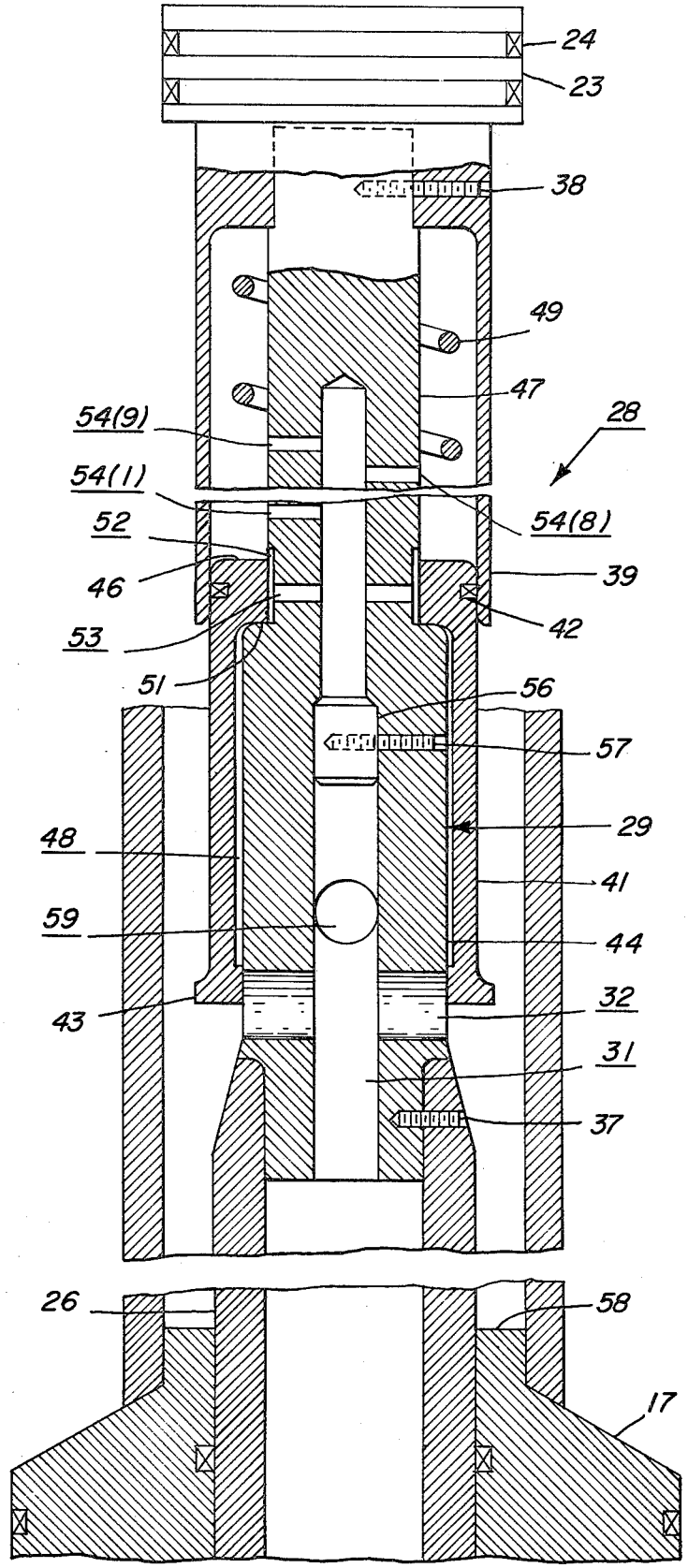

The invention is described in greater detail with reference to the accompanying drawing wherein:

FIG. 1 is a longitudinal cross-section view of a simplified drive arrangement; and FIG. 2 is a longitudinal cross-section view of a drive buffer or braking arrangement in accordance with the invention.

DESCRIPTION

Illustrated in highly simplified form in FIG. 1 is a control rod drive mechanism incorporating the buffer or braking arrangement of this invention. As shown therein a drive 11 includes a main drive cylinder 12 formed with a bottom flanged portion 13 by which it is supported in a housing tube 14 secured (as by welding) through a hole or penetration in the bottom 16 of a pressure vessel or the like.

Fitted for movement within the cylinder 12 is a main drive piston 17 provided with piston ring seals 18. Connecting the drive piston 17 to a control rod drive coupling spud 19 is an index tube 21. The index tube 21 is formed with a series of spaced latch notches 22 which are engaged by latches (not shown herein but shown in U.S. Pat. No. 3,020,887) to provide incremental positioning of the index tube.

Fitted within the bore of index tube 21 is a stop piston 23 provided with piston ring seals 24. Stop piston 23 is retained in fixed position by connection to a stop piston tube 26 secured at its bottom end in a bore in the bottom end of drive cylinder 12 and sealed by a plug 27. Piston rings 35 provide a fluid seal between the stop piston tube 26 and the drive piston 17. The stop piston 23 is connected to the top end of piston tube 26 through the agency of a buffer or braking arrangement 28 which is described hereinafter with reference to FIG. 2. For present purposes it is noted that the buffer 28 includes a buffer shaft 29 formed with a bore 31 and a cross hole 32 which provide a fluid passage between the interior of stop piston tube 26 and an annular space 33 between the piston tube 26 and the index tube 21.

Operation of the drive 11 is, briefly, as follows: For upward motion, pressurized fluid such as water, is supplied through an up-drive passage 34 to the bottom of drive piston 17. Simultaneously, a down-drive passage 36 is opened to a low pressure. Thus as the pressurized water drives piston 17 upward, water in the annulus 33 is driven through the cross hole 32 and bore 31 down piston tube 26 and out of the passage 36.

For downward motion of the drive, the up-drive passage 34 is opened to low pressure and pressurized water is supplied to the down-drive passage 36. The pressurized water passes through piston tube 26, bore 31 and cross hole 32 to annulus 33 by which the water in annulus 33 between stop piston 23 and the top of drive piston 17 is pressurized to drive the piston 17 downward.

Typically, downward motion of the drive (withdrawal of control rod) is incremental (notch-by-notch) and at relatively low speed. On the other hand, upward drive (control rod insertion) is sometimes (such as under scram conditions) a continuous motion at high speed. Upon such rapid insertion, as the drive piston 17 approaches the stop piston 23 near the end of the drive piston stroke, it is necessary to arrest the drive piston motion and dissipate at least a substantial portion of the kinetic energy of the moving parts to avoid excessive mechanical shock on the drive system.

The buffer mechanism 28 serves this purpose and the details of construction and function thereof now will be considered with reference to FIG. 2.

The buffer shaft 29, mentioned hereinbefore, is secured at its lower end to the top end of stop piston tube 26, for example, by a pin 37. Secured to the top end of buffer shaft 29, for example, by a pin 38, is the stop piston 23. The buffer shaft 29 is formed with stepped bore 31 from an open end at its bottom over a substantial part of its length to a closed end near its top.

A downwardly extending, open ended skirt of the stop piston 23 forms a buffer cylinder 39. An annular buffer piston 41 is sized on its outer diameter for sliding fit in the cylinder 39 and it is provided with a piston ring seal 42 near its upper end. At its lower end the piston 41 is formed with an inwardly and outwardly extending lower flange portion 43 with an inside diameter sized for sliding fit on the large diameter portion 44 of shaft 29. At its upper end the piston 41 is formed with an inwardly extending upper flange portion 46 with an inside diameter sized for sliding fit on the smaller diameter portion 47 of shaft 29. The inside diameter of the body portion of piston 41 is such as to provide an annular fluid flow space 48.

A spring 49 within the cylinder 39 urges the piston 41 out of the cylinder whereby the upper flange 46 is forced into engagement with a shoulder 51 formed by the diameter transition of shaft 29. This engagement provides a seal for retaining water in the cylinder 39.

Near its diameter transition, the shaft 29 is formed with an annular recess 52 connected for fluid flow by a cross hole 53 to the bore 31 of shaft 29. To provide the desired braking action, a series of spaced axial apertures or holes 54(1)–54(9) are formed in the small diameter portion of the shaft 29 within the cylinder 39, these holes providing fluid flow passages between the interior of cylinder 39 and the upper portion of the bore 31 of shaft 29.

A plug 56, secured for example by a pin 57, prevents direct fluid flow from the upper to the lower portion of the bore 31. The plug 56 together with the engagement of the piston flange 46 against the shoulder 51 retains the water, necessary for braking action, within the cylinder 39. This sealing of the water within the cylinder 39 is necessary to prevent its flashing to steam, and consequent loss thereof, under certain conditions of temperature and pressure. It will be recalled from the discussion of FIG. 1 that drive insertion is accomplished by applying pressurized water through the up-drive passage while opening the down-drive passage to low pressure, this low pressure being communicated through the piston tube 46 to the bore 31 of shaft 29.

Thus without the plug 56 the water in the cylinder 39 could be subjected to a sudden pressure loss of, for example, in the order of 500 psig. If the water is at a temperature of 250° F. or higher at that time, flashing to steam and consequent loss of buffer water occurs. The sealing of the cylinder, as described, prevents this problem.

Operation of the buffer arrangement 28 and further details thereof are as follows: Upon insertion of the drive as described hereinbefore, as the main drive piston 17 nears the end of its stroke the upper annular surface (designated 58 in FIG. 2) of the drive piston engages the lower flange 43 of the buffer piston 41 and drives the piston 41 into the buffer cylinder 39. This unseats the buffer piston upper flange 46 from its seal against the shoulder 51 and allows water to escape from the cylinder, initially through the recess 52 and then through the holes 54(1)–54(9). The flow path is as follows: through the holes 54(1)–54(9) to the upper portion of the bore 31, outward through cross hole 53 into the annular space 48, inward through a cross hole 59 to the bottom portion of the bore 31 and, thence, downward into stop piston tube 26. As the buffer piston 41 is driven further into the cylinder 39 its upper flange 46 successively covers the holes 54(1)–54(8) in turn. This progressively increases the resistance to flow of the water from the cylinder, thus dissipating the kinetic energy of the moving parts and providing the requisite braking action.

What is claimed is:

1. In a vertically oriented linear motion-producing device for a nuclear reactor including a stationary elongated main cylinder, a stationary elongated tubular element coaxially disposed in said main cylinder to provide an annular drive fluid space between said tubular element and said main cylinder, a double-acting driving piston reciprocably disposed in said annular drive fluid space, a connecting tube secured to said driving piston and extending from said annular drive fluid space for connection to a load, and means for introducing and removing drive fluid to and from said annular drive fluid space to move said driving piston and said connecting tube in either direction, the improvement comprising buffer apparatus for braking said driving piston near the end of its upward stroke including: a buffer cylinder positioned within said connecting tube and open at its lower end; a buffer shaft connected at its lower end to said tubular element, extending coaxially through said buffer cylinder and secured at its upper end thereto, said buffer shaft being formed with a longitudinal bore closed at its upper end and open to said tubular element at its lower end and with a small diameter portion within said buffer cylinder, a diameter transition forming a shoulder near the open end of said buffer cylinder and a large diameter portion between the open end of said buffer cylinder and the upper end of said tubular element; an annular buffer piston disposed coaxially on said buffer shaft and providing an annular buffer fluid flow space therebetween, said buffer piston having an outside diameter sized for sliding fit in said buffer cylinder, said buffer piston being formed with an upper flange with an inside diameter sized for sliding fit on said small diameter portion of said buffer shaft and being formed with a lower flange with an inside diameter sized for sliding fit on said large diameter portion of said buffer shaft; spring means in said buffer cylinder urging said buffer piston out of said buffer cylinder whereby said upper flange of said buffer piston normally engages said shoulder of said buffer shaft; a fluid-tight plug in said bore of said buffer shaft positioned below said shoulder of said buffer shaft and dividing said bore into a lower bore portion and an upper bore portion, said plug and the engagement of said upper flange of said buffer piston against said shoulder of said buffer shaft normally sealing said cylinder against escape of buffer fluid therefrom; a radial hole in said large diameter portion of said buffer shaft providing a fluid passage between said annular buffer fluid flow space and said lower bore portion of said buffer shaft; a plurality of relatively small radical braking holes providing fluid passages between the interior of said buffer cylinder and said upper bore portion of said buffer shaft; fluid passage means in said buffer shaft near said buffer shaft shoulder providing fluid passage from said upper bore portion of said buffer shaft to said annular buffer fluid flow space when said upper flange of said buffer piston is unseated from said shoulder of said buffer shaft by engagement of said driving piston with said lower flange of said buffer piston, said driving piston moving said buffer piston into said buffer cylinder whereby said buffer piston seals off said braking holes in succession to thereby increase resistance to buffer fluid flow from said buffer cylinder and to thus dissipate the kinetic energy of the driving piston and connected moving elements to reduce their velocity near the end of the driving piston to stroke.

2. In the device of claim 1 wherein said fluid passage means includes a radial hole in the small diameter portion of said buffer shaft adjacent said shoulder of said buffer shaft and a recess in the surface of said small diameter portion of said buffer shaft adjacent said shoulder of said buffer shaft.

3. In a linear motion-producing device for a nuclear reactor including a stationary main cylinder and a driving piston disposed for reciprocal motion in said main cylinder, buffer apparatus for braking said driving piston near the end of its stroke in a given direction comprising: a stationary buffer cylinder for containing buffer fluid coaxially disposed in said main cylinder; a buffer piston disposed for reciprocal motion in said buffer cylinder; resilient means in said buffer cylinder for urging said buffer piston out of said buffer cylinder in the direction of said driving piston; a buffer piston stop for engaging said buffer piston to limit its movement out of said buffer cylinder and to normally seal said buffer cylinder to prevent escape therefrom of said buffer fluid; means providing engagement of said buffer piston with said driving piston as said driving piston nears the end of its stroke whereby said buffer piston is moved from said buffer piston into said buffer cylinder thereby unsealing said buffer cylinder and allowing flow of buffer fluid therefrom; a buffer fluid passage member in said buffer cylinder including a plurality of spaced buffer fluid flow passages, said buffer piston successively covering each said buffer fluid flow passage in turn as the buffer piston is driven by said driving piston further into said buffer cylinder whereby resistance to fluid flow from said buffer cylinder progressively increases to provide increasing braking force against said driving piston.

4. In a linear motion-producing device for a nuclear reactor including a stationary main cylinder and a driving piston disposed for reciprocal motion herein, buffer apparatus for braking said driving piston near the end of its stroke in a given direction comprising: a stationary buffer cylinder for containing buffer fluid coaxially disposed in said main cylinder; a stationary buffer fluid passage member coaxially disposed in said buffer cylinder including a plurality of spaced holes therein for conducting buffer fluid from said buffer cylinder; an annular buffer piston mounted on said buffer fluid passage member and disposed for reciprocal motion in said buffer cylinder; resilient means urging said buffer piston in the direction of said driving piston; buffer piston stop means engaging said buffer piston for limiting movement of said buffer piston and for normally sealing said buffer cylinder to prevent escape of said buffer fluid therefrom; means providing engagement of said buffer piston with said driving piston as said driving piston nears the end of its stroke whereby said buffer piston is disengaged from said buffer piston stop means and moved along said buffer cylinder thereby unsealing said buffer cylinder and allowing flow of buffer fluid therefrom through said spaced holes of said buffer fluid passage member, said buffer piston successively closing off each of said holes as said buffer piston is driven by said driving cylinder further along said buffer cylinder whereby resistance to fluid flow from said buffer cylinder progressively increases to provide increasing braking force against said driving piston.

* * * * *